United States Patent [19]

Cull

[11] Patent Number: 5,028,154

[45] Date of Patent: Jul. 2, 1991

[54] REVERSIBLE PRINTING STATION

[75] Inventor: William J. Cull, Dayton, Ohio

[73] Assignee: Mead Data Central, Inc., Dayton, Ohio

[21] Appl. No.: 538,799

[22] Filed: Jun. 15, 1990

[51] Int. Cl.[5] ..... B41J 11/46

[52] U.S. Cl. ..... 400/611; 400/613.2; 400/472; 400/6.92; 361/393

[58] Field of Search ..... 400/611, 613, 613.2, 400/613.3, 613.1, 682, 692, 693, 472; 361/390–394

[56] References Cited

U.S. PATENT DOCUMENTS

| | | | |
|---|---|---|---|
| 4,330,776 | 5/1982 | Dennison, Jr. et al. | 400/682 |
| 4,527,285 | 7/1985 | Kekas et al. | 361/393 |
| 4,552,453 | 2/1987 | Estabrooks | 400/613.2 |
| 4,729,681 | 3/1988 | Moser | 400/613.2 |
| 4,734,710 | 3/1988 | Sato et al. | 400/611 |
| 4,853,838 | 8/1989 | Westermann | 361/390 |
| 4,881,839 | 11/1989 | Grimm | 400/692 |
| 4,976,559 | 12/1990 | Imagaki | 400/693 |

FOREIGN PATENT DOCUMENTS

| | | | |
|---|---|---|---|
| 0278066 | 12/1987 | Japan | 400/472 |
| 0199669 | 8/1988 | Japan | 400/692 |

*Primary Examiner*—Eugene H. Eickholt

*Attorney, Agent, or Firm*—Biebel & French

[57] ABSTRACT

A printing station assembly includes a printer having drive means for feeding continuous form feed paper from a position below the printer, and through the printer. The paper is discharged through the rear of the printer where it is accumulated in a paper collection tray. The printer can be oriented in two different configurations, where the paper collection tray is either facing or opposing the user. To facilitate such alternate orientations, the printer has alternate locations for the printer control panel, one adjacent to the front side of the printer, and one adjacent to a rear side of the printer, and adjacent to the paper discharge side of the printer.

24 Claims, 8 Drawing Sheets

28
40
16
10
20
12
38
22
15
42
30
56
54
18
16
24
14
13

18
12
36
30
34
40
54
42
3
15
56
50
3
20
69
32
38
68
77
13
14

REVERSIBLE PRINTING STATION

BACKGROUND OF THE INVENTION

The subject invention relates to a printing station which can be reversed for alternate positioning of the paper collection tray.

DISCUSSION OF THE PRIOR ART

Printers are presently adapted to function with paper configured in a continuous loop, such paper generally referred to as continuous form feed paper, and including removable carrier strips flanking the sides of the paper. The carrier strips include drive holes equally spaced along the length thereof for continuous feeding of the paper into the printer. The complementary printer usually includes tractor feed rollers aligned with the carrier strips, with the rollers having tractor pins adapted to mesh with the carrier strip holes and feed the paper into the printer, upon driving the rollers.

Typically, the continuous form feed paper is fed into the rear of the printer from a position below the printer and around a print roller, intermediate the drive rollers, to a position proximate to a printing head. The printed paper forms a continuous loop around the print roller and is discharged in the opposite direction, at the rear of the printer. A paper collection tray is generally placed at the rear of the printer to accumulate the printed paper.

Such printers also typically include control panels positioned adjacent to the front of the printer to allow the user to control the printing functions. These control panels generally include indicator lights to indicate various modes of operation, and control switches to change the various modes. For example, the control panels often include indicator lights which are illuminated when the power to the printer is on, and when the printer is in the ON-LINE mode of operation, to name just a few, indicating that the printer is ready to print.

While such printers are suitable for some applications, these printers can present problems in applications where floor space is at a premium. As described above, these printers generally receive and discharge the continuous form feed paper from the rear side, where it is accumulated in a discharge tray. Thus, when the printers are positioned to access the control panels, the paper collection trays are placed distal from both the user and the control panels. Thus, if the printer is positioned proximate to a wall or other obstruction, the collection tray is generally abutted up against the wall, and the collected paper is difficult to retrieve, as one must reach over the top of the printer or around its side. The printer cannot be reversed as the printer control panel would then be inaccessible.

It is an object of the invention then to provide a printing station which is reversible for operation in alternative directions, that is, where the paper collection tray can be used in either a facing or opposing relation relative to the user.

It is a further object of the invention to provide a printing station where the orientation of the printing station is user definable.

Other objects and advantages of the invention will be apparent from the following description, the accompanying drawings and the appended claims.

SUMMARY OF THE INVENTION

The object of the invention was accomplished by providing a printing station having an outer printer housing including a first side and an opposite second side where the housing has a first opening means adjacent to the first side and a second opening means adjacent to the second side. A printing head means is located intermediate the first and second sides. The printing station further comprises paper feed means for feeding continuous paper from the second side to the printing head and delivering the printed continuous paper in a return direction towards the second side. The printing station also includes paper collection means positioned adjacent to the second side for collecting the printed continuous paper from the printing head. Finally, the printing station includes a modular printer control means adapted for functional location in either the first or second opening means thereby allowing the printing station to be rotated for alternate access to either the first or second side.

In this manner, the printing station can be rotated such that the printer output tray is accessible, and the modular printer control means can be removed from the first opening means and placed in the second opening means, to control the printer from the side adjacent to the paper collection tray. This places the paper collection tray and the control panel on an open and unobstructed side, facing the user.

DETAILED DESCRIPTION OF THE PREFERRED EMBODIMENT

Figure 1:
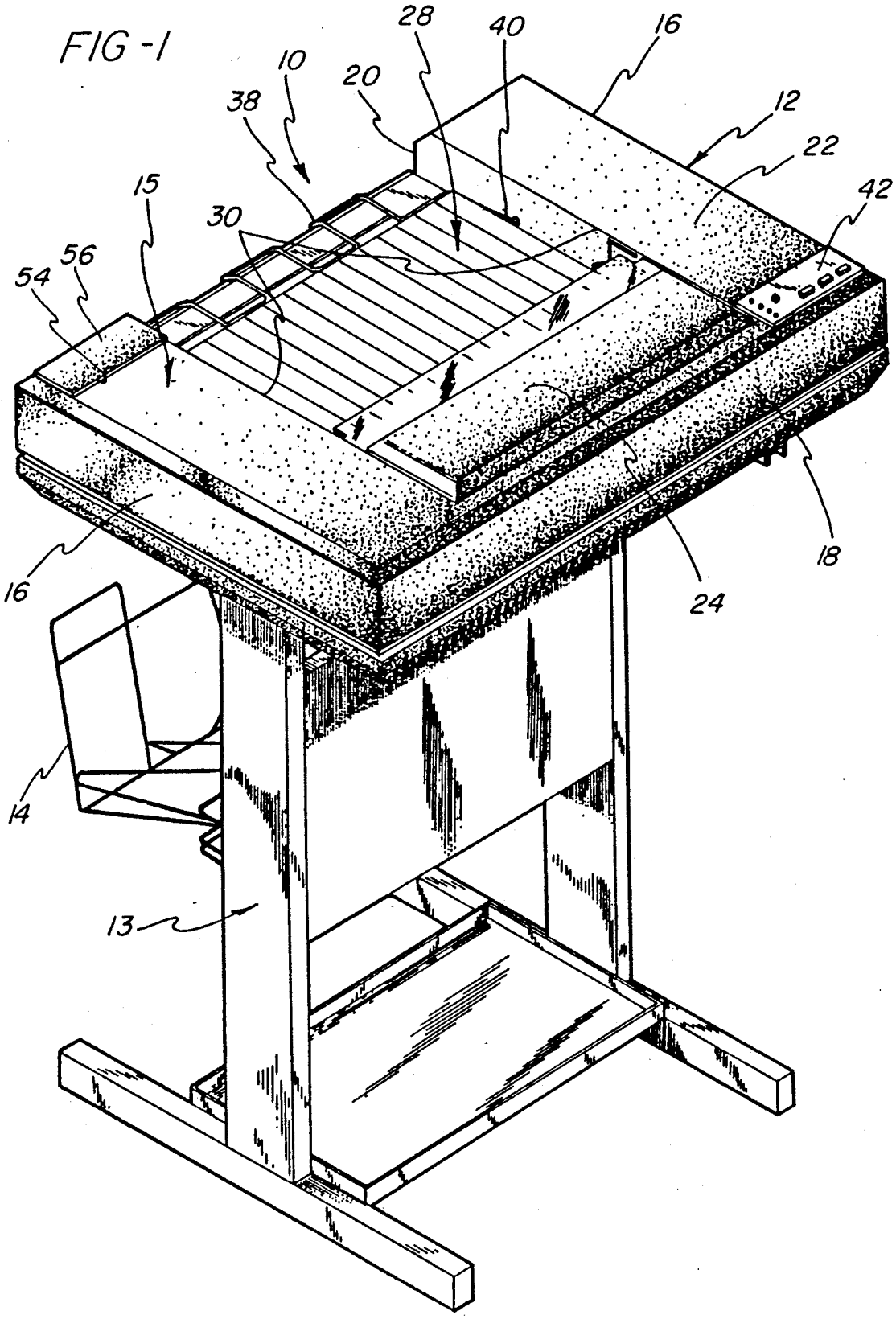
FIG. 1 is a front isometric view of the printer assembly of the present invention.
Figure 2:
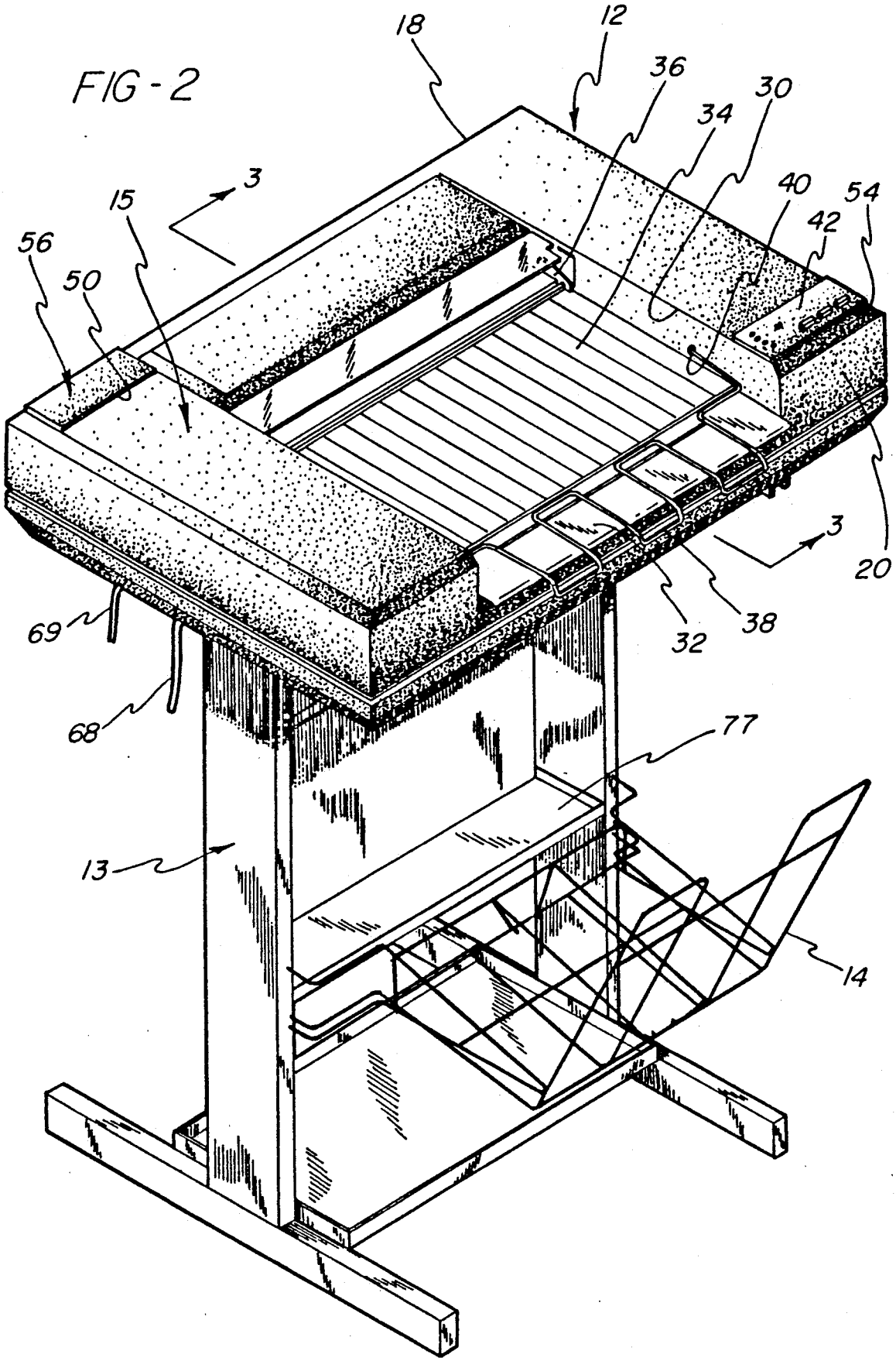
FIG. 2 is a rear isometric view of the printing station assembly of the present invention.

With respect first to FIG. 1, a printing station assembly is shown generally at 10 comprising a printer 12 supported by a printer stand 13, and further comprising a paper collection tray 14 positioned so as to accumulate the output printed paper. With reference now to FIGS. 1 and 2, the printer 12 will be described in greater detail.

Figure 3:
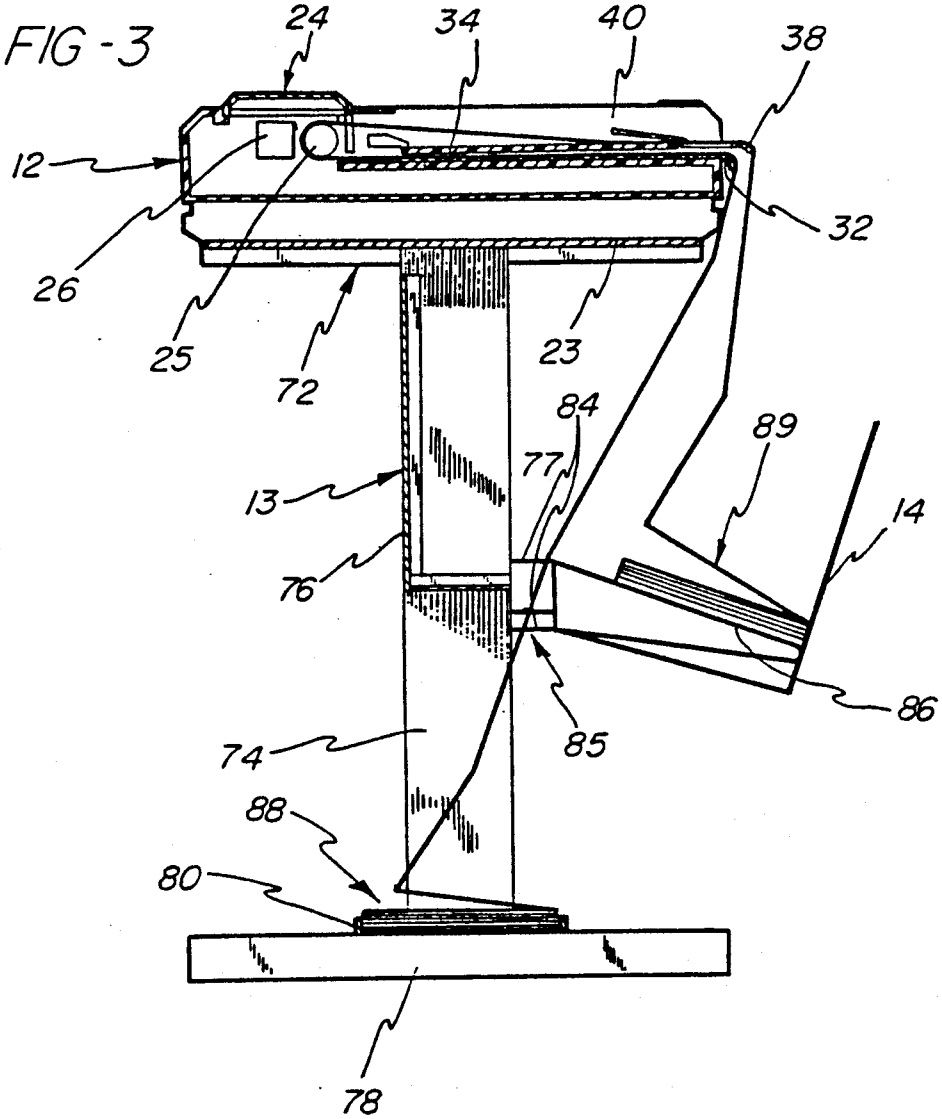
FIG. 3 is a cross-sectional view through lines 3—3 of FIG. 2, with the addition of the continuous form feed paper.

The printer 12 generally comprises an outer insulating housing 15 having side walls 16, a front wall 18, a rear wall 20, an upper face 22, and a lower support face 23, (FIG. 3). As shown in FIG. 3, the printer 12 further comprises a printing section 24 having a paper feed roller 25 proximate to a printing engine shown generally at 26. In the preferred embodiment of the invention, the print engine is a Siemens PT-90 ink jet having 32 nozzles. The printing section 24 is generally in line with a paper receiving channel 28, where the paper receiving channel 28 is defined by side walls 30, and a paper receiving plate 32 located between the two side walls 30, as shown in FIG. 2. A rotatable paper guiding plate 34 rests on the fixed plate 32 and is hinged to the side walls 30 by means of hinge arms 36. A wire formed paper guide 38 is also hingedly mounted to the side walls 30 of the printer, by hinges 40.

Figure 4:
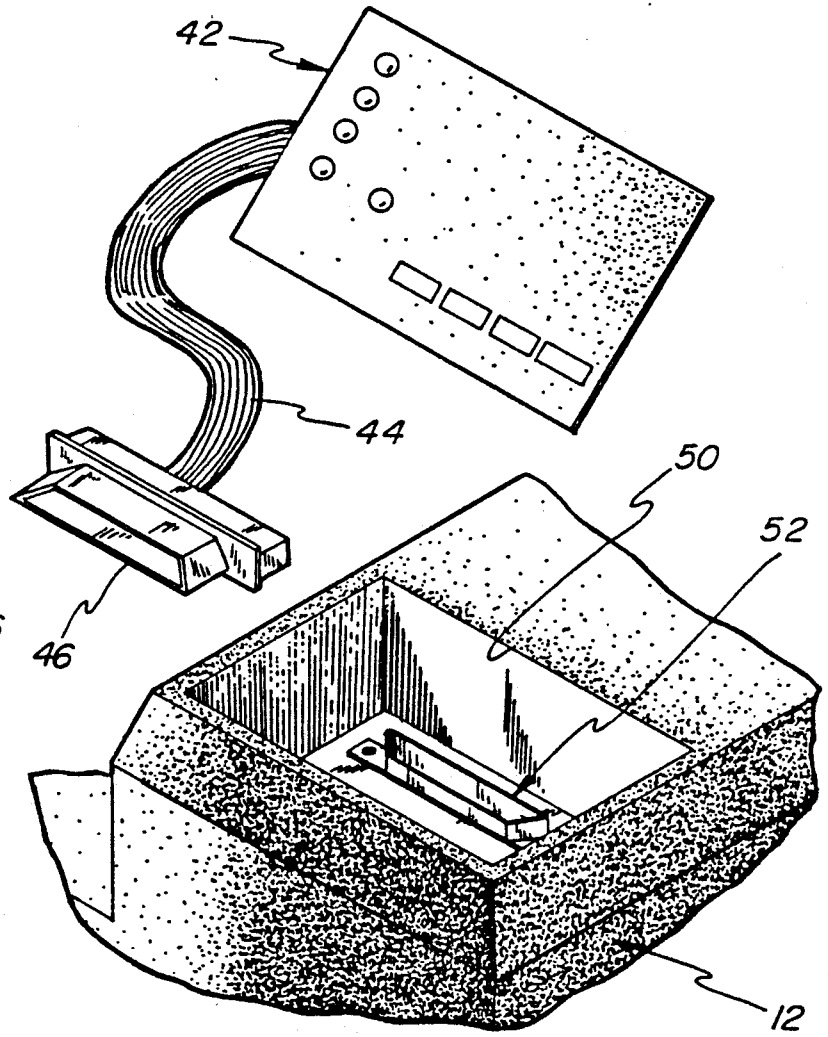
FIG. 4 is an enlarged view of the front corner of the printer illustrating one of the access ports and the control panel exploded from the port.

As shown in FIG. 1, the printer 12 further comprises a control panel 42 located proximate to the front edge 18 of the printer. As shown in FIG. 4, the control panel is interconnected to a ribbon cable 44 having an electrically shielded connector 46 terminated to the free end of the ribbon cable 44. The printer 12 also includes an opening or port 50 having mounted therein, a shielded connector 52 which is complementary with the shielded connector 46.

Although described in greater detail herein, as shown in FIG. 1, the printer 12 includes a second port 54, diagonally opposed from port 50 and has a cover plate 56 covering the port 54 for aesthetics. Suffice it to say at this point, that the cover plate 56 is removable and includes an identical connector 57 (FIG. 5) connected to the connector 52, such that the control panel 42 can be positioned at either port 50 or 54 for operation of the printer in either direction. Said differently, the printing station can be used in the configuration shown in FIG. 1 where the front wall 18 faces the user, or can be used in the configuration shown in FIG. 2, where the control panel 42 is disposed in the port 54, and the printing station is rotated 180°, such that the rear wall 20 and the collection tray 14 face the user.

Figure 5:
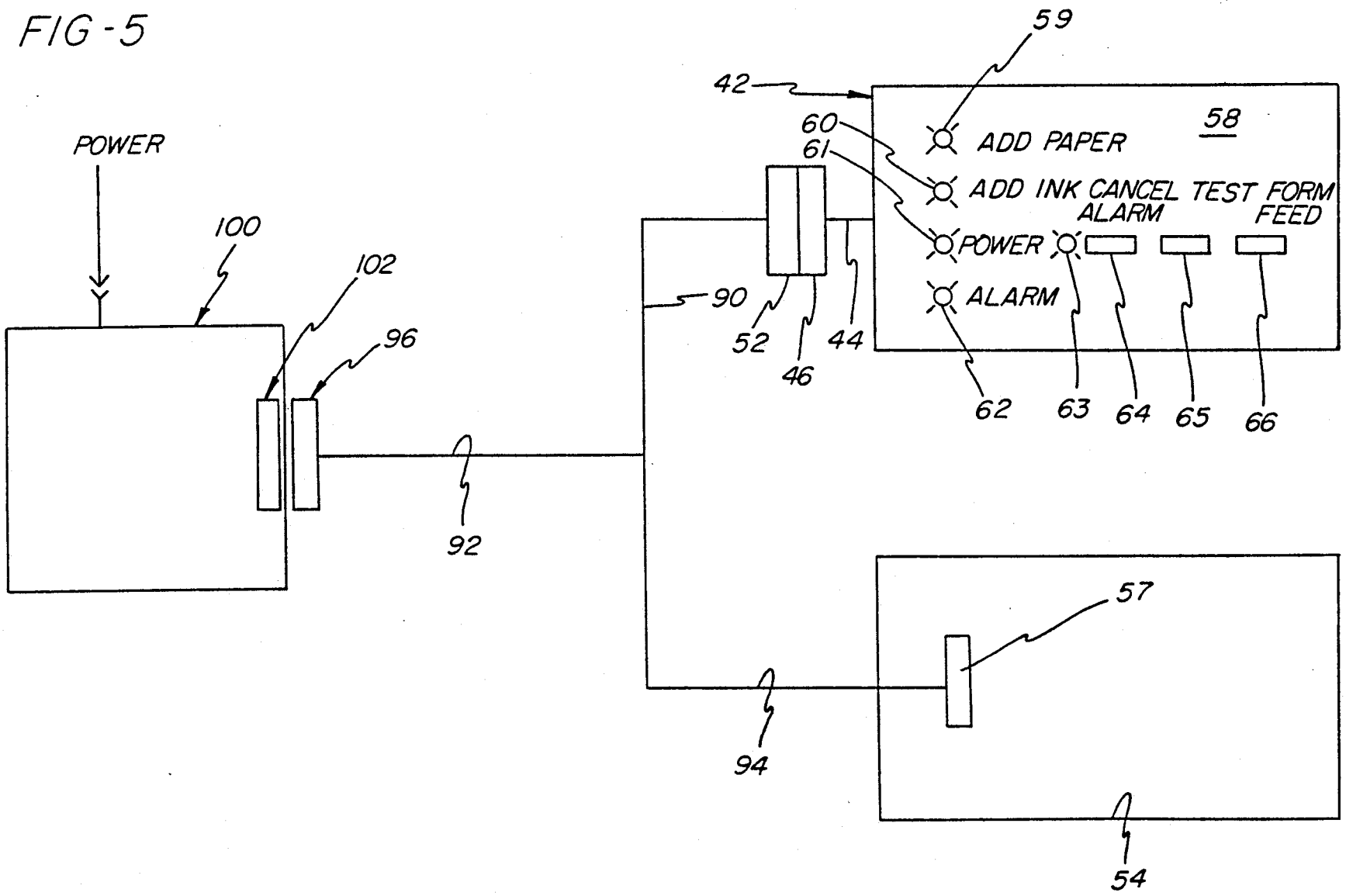
FIG. 5 is a diagrammatical view of the printer control assembly.

As shown in FIGS. 4 and 5, the control panel 42 comprises an insulating plate section 58 having a plurality of indicators lights, such as 59–63, and a plurality of momentary contact switches, such as 64–66, for the control of the printer. While described in greater detail herein, the indicator light 61 is illuminated when the power is activated, through the main power cable 68. When the switch 64 is activated, the printer is ON-LINE and the indicator light 63 is also illuminated, indicating that the printing engine is ready to print data received.

If the switch 64 is activated again, the printer is OFF-LINE and the test or form feed switches 65, 66 can be used. The test switch 65 causes text to be read from memory and commands the printing engine to print out that text for test purposes. The form feed line is also used in the OFF-LINE mode and feeds one sheet of paper through the printer, generally used to clear from the printer a partially printed page.

The indicator light 59 is illuminated when the printer is out of form feed paper, while the indicator light 60 illuminates when the printer is out of ink. The indicator light 62 is constantly illuminated when there is data present in the print buffer, but is flashing when an alarm signal is present. When an alarm signal is present, the printer automatically converts to the OFF-LINE mode, and depression of the ON-LINE switch 64 disarms the alarm.

As shown in FIG. 2, the printer 12 further includes a power input cable 68 proximate to the switch extending through the lower surface of the printer. The printer also includes data input cable 69, which in the preferred embodiment of the invention is a telephone type connection, and preferably an RJ-11 phone jack with a complementary plug, although alternatively, an RJ-45-S telephone jack is also suitable. Both the power input cable 68 and the data cable 69 extend into the printer through the lower surface to keep the rear face 20 free of such connections. In that manner, the printer can be reversed without regard to the location of the power and data connections, and the rear surface can be provided as a finished aesthetically acceptable viewing surface.

As shown now in FIGS. 2 and 3, the printer 12 is supported on the printer stand 13, where the stand includes two support legs 74 with an upper plate 76 and a cross brace 77, interconnecting the two support legs 74. The support legs 74 are interconnected at their lower end by floor braces 78 and a further support plate 80 is positioned between the two support legs 74. The paper collection tray 14 is positioned below the rear wall 20 of the printer and attached to rear edges of the support legs 74. The collection tray 14 comprises a wire formed upper support portion formed generally at 86 as shown in FIG. 3, to collect and accumulate the printed paper.

With reference now to FIG. 3, the printer 12 and the printer stand 13 are shown configured with a stack of continuous form feed paper, such as 88, supported by the lower shelf 80, and fed through an opening 85 of the paper collection tray 13, and into the printer 12. The paper is fed above the support plate 32 and below both the wire guide 38 and the paper guiding plate 34. The continuous paper 88 is thereafter wrapped around the feed roller 25 in proximity to the printing engine 26 for the printing of the data onto the continuous form paper 88. The paper is thereafter fed out of the printer on top of both the guiding plate 34 and the wire guide 38, and is accumulated at 89 in the paper collection tray 14.

With reference now to FIG. 5, the control portion of the printer is shown diagrammatically. The removable control panel 42 is shown with the interconnected ribbon cable 44 and the terminated connector 46. The connector 46 is interconnected to connector 52 which, as shown in FIG. 4, is disposed within the port 50. The alternate identical connector 57 is shown diagrammatically disposed in the corresponding port 54 which, as shown in FIGS. 1 and 2, is diagonally opposed from the port 50. The control panel 42 is interconnected to a cable 90 via the electrical connectors 46, 52, and the cable portion 90 is continuous with a cable portion 92, having an electrical connector 96 terminated to its free end. The cable portion 92 is also common with a cable portion 94 which extends into the second port 54 and is interconnected to the connector 54.

Cable portions 90, 92 and 94 are shown and described herein as separate cables, although these cable sections could be one or more separate cables. In the preferred embodiment of the invention, the cables are ribbon type cable having a plurality of side-by-side electrical conductors encapsulated within insulative material. Thus, two separate cables could be used, where one cable extends between connector 96 and 52, while another cable extends between connector 96 and 57, where the cables connected to connector 96 are commoned to the same terminals. Alternatively, one cable could be used, where the free ends of the cable have connectors terminated thereto, while a third connector is terminated to the cable, intermediate the other two, in the so-called "daisy-chain" configuration. In the preferred embodiment of the invention, the latter configuration is used, as this type of cable harness is easier to manufacture, and requires less cable. Other cable harness configurations are also possible to provide common interconnections at connectors 52 and 57.

With reference still to FIG. 5, the timing function of the printer is controlled by a timing board 100 having a timing chip (not shown) thereon. The timing board 100 includes an electrical connector 102, such as a header connector, disposed along an edge thereof. The header 102 is interconnectable to the connector 96, thereby interconnecting the control panel 42 to the timing board 100, through the cable portions 90 and 92. Alternatively, the control panel 42 can be located at port 54 and interconnected to the timing board via the cable portions 92 and 94. It should be appreciated then, that the connector 57 is identical to that of connector 52, and that the control panel 42 can be positioned adjacent to either of the ports 50 or 54, and yet can still be interconnected to the timing board 100 for control of the printer 12.

Figure 6:
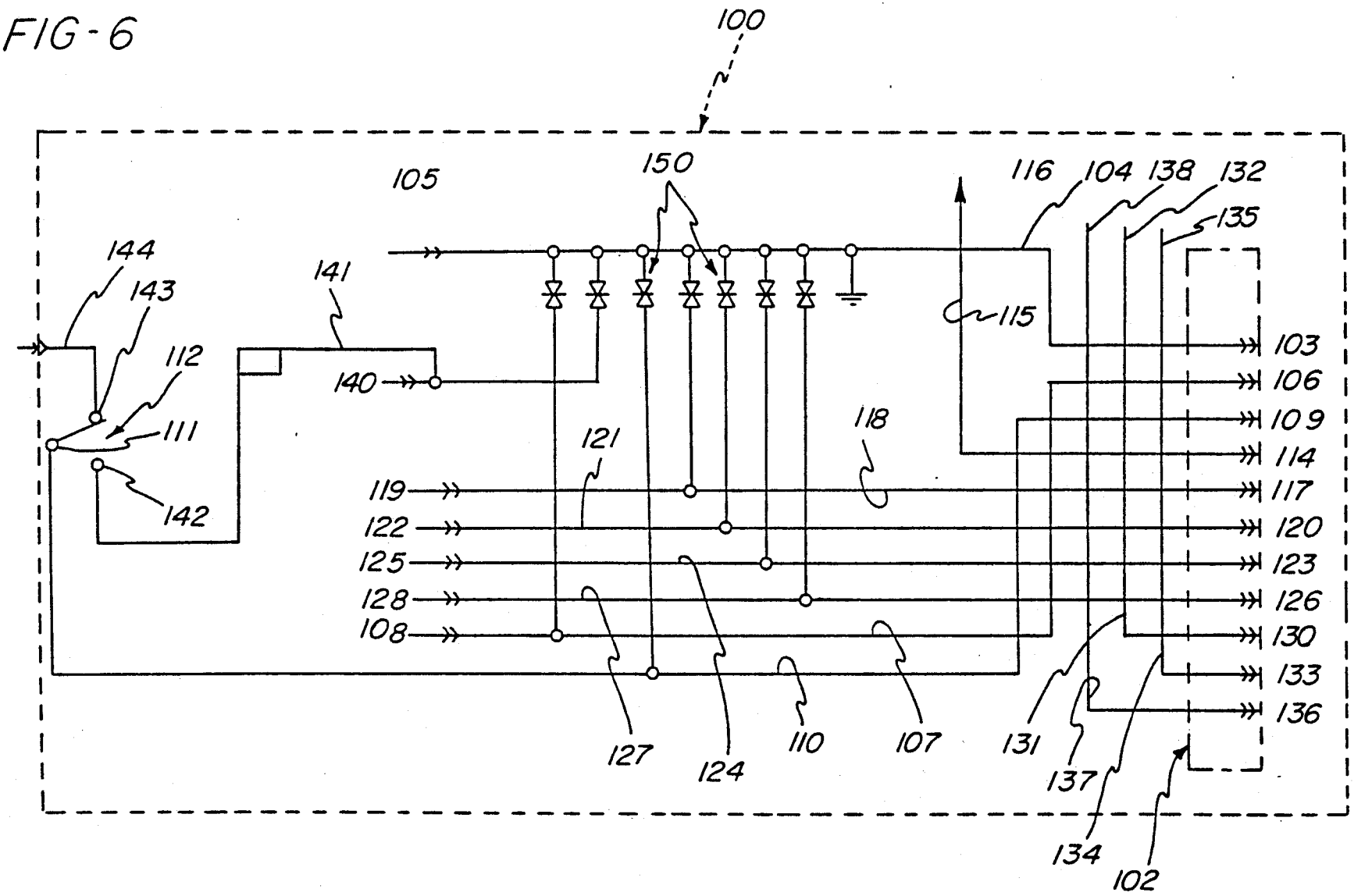
FIG. 6 is a schematic view of the relevant portions of the timing board used in the control assembly of the present invention.

With reference now to FIG. 6, the timing board 100 is shown schematically in a circuit diagram with the relevant portions of the circuit included. As described above with reference to FIG. 5, the printed circuit board 100 includes a connector member 102 adjacent to a side edge thereof for the interconnection with the connector 96. In the preferred embodiment of the invention, the header 102 is of the type having an insulating housing mounted to the printed circuit board 100, where a plurality of pin-like terminals are interconnected to conductive traces (not shown) on the printed circuit board by means of a soldered connection, or by a compliant contact section. However, other types of connections, such as edge card connectors, are also suitable alternatives.

With more particularity to FIG. 6, the electrical connector 102 includes a connection 103 interconnected to a circuit trace 104 which is suitably grounded at 105 to provide for a common ground therealong. The connector 102 further comprises a connection 106 interconnected to a circuit trace 107 which is used to send a form feed signal at 108 to the paper feed motor (not shown) on the printer 12. The connector 102 also includes a connection 109 interconnected to a trace 110 which is the common connection 111 of switch 112. Connection 114 is common to a trace 115 which is thereafter interconnected to trace 116, and used as the ON-LINE signal, as described in greater detail herein. The connector 102 also includes a connection 117 interconnected to a printed circuit board trace 118 which receives at 119 a +5 volt light signal. The connector 102 further includes a connection 120 interconnected to a trace 121 which receives at 122 an ON-LINE light signal from the printer engine 26. A connection 123 is interconnected to a trace 124 and is connected at 125 to a printing light signal received from the printing engine 26. A connection 126 is interconnected to an electrical trace 127 which receives at 128 a power light signal from the printing engine 26.

The header connector 102 also includes a connection 130 interconnected to an electrical trace 131 which receives at 132 an electrical signal from the ink jet printer, a signal for a low level of ink. The connector 102 also includes a connection 133 interconnected to an electrical trace 134 which receives at 135 a signal from the ink jet printer, to add paper to the printer. A connection 136 is interconnected to an electrical trace 137 on the printer circuit board which receives an external power source at 138.

With reference still to FIG. 6, the timer board 100 further includes an output connection 140 interconnected to a trace 141 thereafter connected to one of the poles 142 of the switch 112. The opposite pole 143 is interconnected to a test signal at 144.

As shown in FIG. 6, each of the electrical printer circuit board traces 110, 107, 127, 124, 121, and 118, includes electronic devices, such as 150, interconnected between the aforesaid traces and the ground trace 104. As the connectors 46, 52 and 57 are manually connected and disconnected by the user, the electronic devices 150 are to prevent an electrostatic discharge by the user's hand through the traces thereby harming the timer chip or other electronic devices interconnected thereto. In a preferred embodiment of the invention, the electronic devices 150 are metal oxide varistors and adapted to shunt to ground, voltages exceeding 40 volts.

Figure 7:
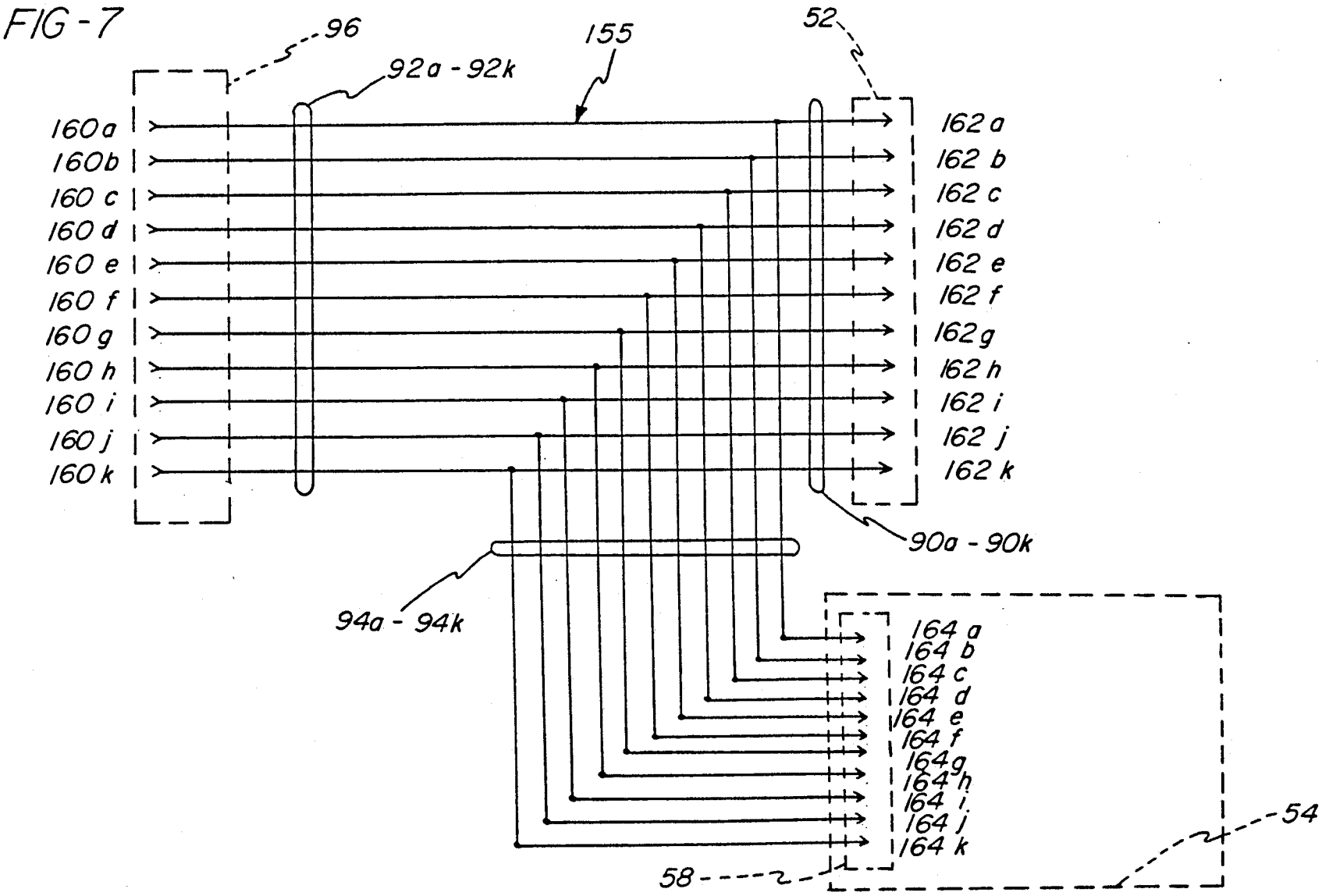
FIG. 7 is a schematic view of the cable assembly used in the present invention.

With respect now to FIG. 7, the electrical harness is shown generally at 155, having conductor portions **90*a*–90*k* interconnected to the electrical connector 52, conductor portions 92*a*–92*k* interconnected to the electrical connector 96, and electrical conductor portions 94*a*–94*k* interconnected to the electrical connector 58. With the conductor portions 94 commoned with the conductor portions 92, as shown in FIG. 7, each of the connectors 96, 52, and 58 have common signals at common terminal locations in the connectors. For example, connector 96 has connections 160*a* through 160*k*, connector 52 has connections 162*a* through 162*k*; and connector 58 includes connections 164*a* through 164*k*. Thus, each connector terminal position designated by a lower case letter is common throughout the harness 155, for example, terminal positions 160*a*, 162*a* and 164*a*** are each commoned by the cable harness connections.

Figure 8:
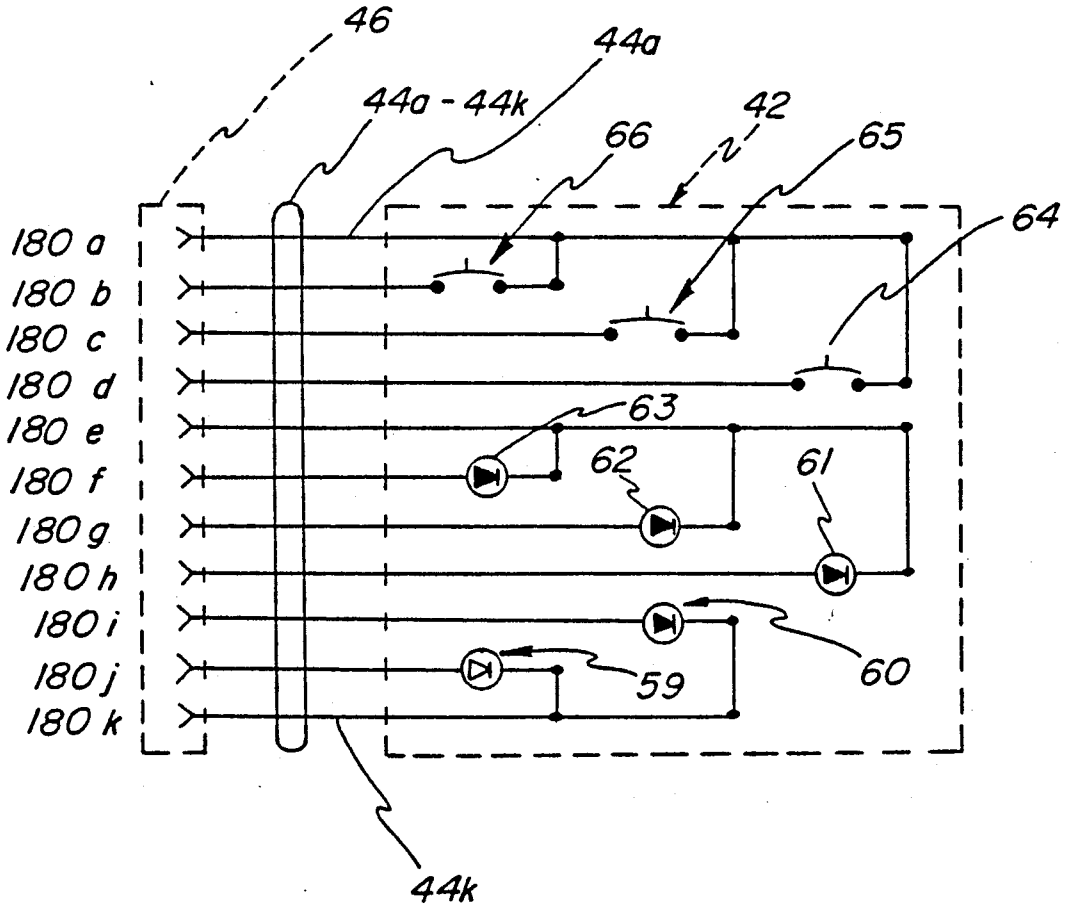
FIG. 8 is a schematic view of the control panel of the present invention.
Figure 9:
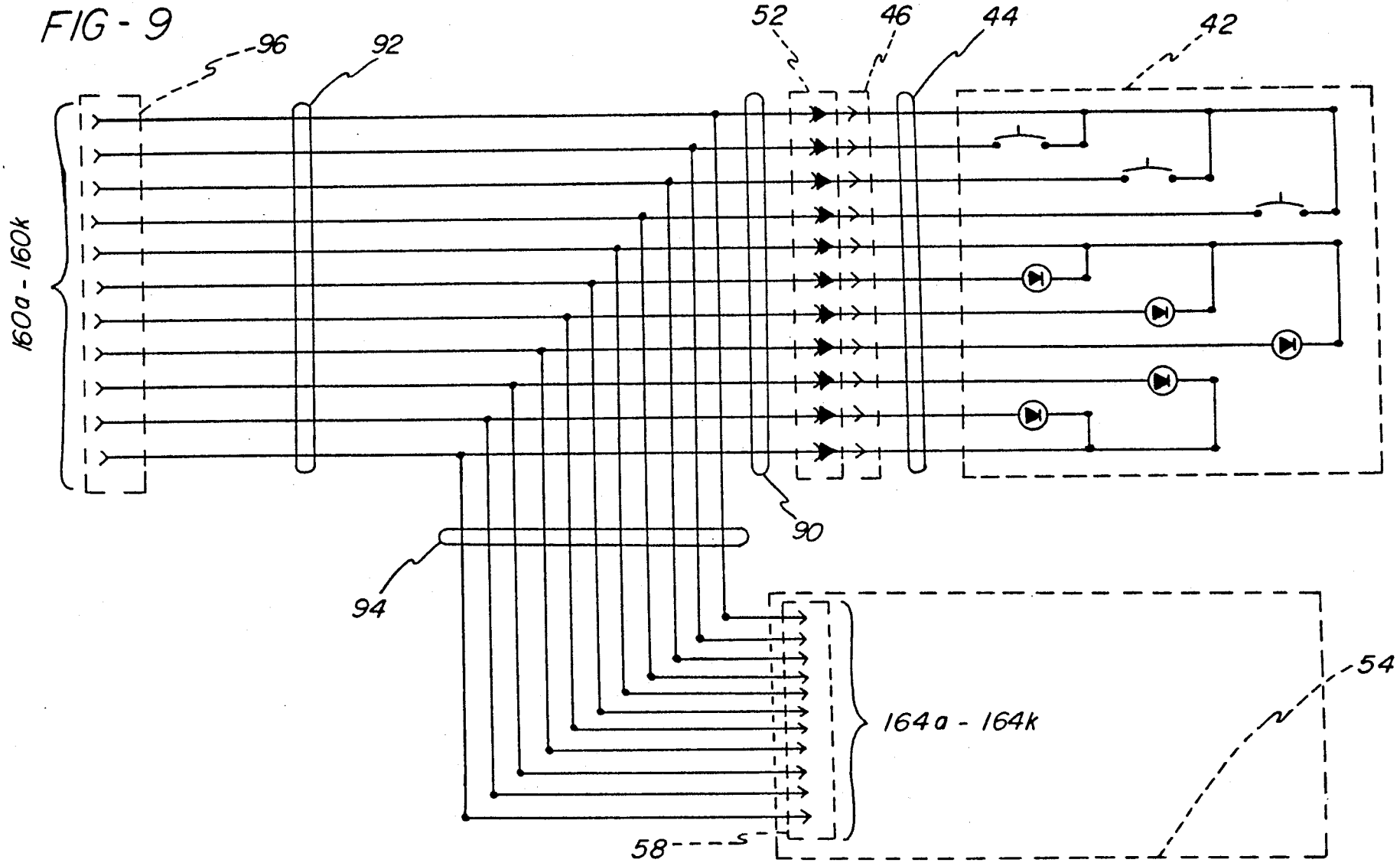
FIG. 9 is a schematic view of the cable assembly of FIG. 7 and the control panel of FIG. 8 in a connected configuration.

With reference now to FIG. 8, the electronic control panel 42 includes an electrical ribbon cable 44 interconnected to an electrical connector, such as 46, having connections **180*a* through 180*k*, where the connections 180*a* through 180*k* are electrically interconnectable with the connections 162*a* through 162*k* of the electrical connector 52 or, alternatively, the connections 164*a* through 164*k* of the electrical connector 58. As described above, the control panel 42 also comprises momentary contact switches 64–66, where each is interconnected to a common terminal connection 180*a* of the connector 46, and thereafter interconnected to the common ground 104, FIG. 6**.

The momentary contact switches 66, 65, and 64 are interconnected to the connections **180*b*, 180*c*, and 180*d* via the cable conductors 44*b*, 44*c*, and 44*d*, respectively. The momentary contact switches 66, 65, and 64 function as the ON-LINE, the test, and the form feed, control switches for the printer, respectively. The momentary contact switch 64 sends a signal through the conductor 44*d* and thereafter to the printer engine 64 through trace 116 (FIG. 6**).

Momentary contact switch 65 is interconnected between common ground **44*a* and conductor 44*b*, which is interconnected to the common switch position 111, as shown in FIG. 6. Thus, as mentioned before, the switch functions in an alternative line feed/test mode, depending on the position of the switch 112. If switch 112 commons poles 111 and 143, the momentary contact switch 65 functions in the test mode, and depression of the switch sends a signal at 144 to the printer engine to print the test text from memory. Alternatively, if the switch 112 commons poles 111 and 142, depression of the momentary contact switch 65 functions in the line feed mode and depression of the switch sends a signal at 140** to the paper feed motor to index the paper by one line.

Finally, the switch 66 is interconnected between conductors 44*a* and 44*b* and depression of the switch 66 sends a signal through 108, as shown in FIG. 6, to index the paper by one page. Thus, when any of these switches 64, 65, or 66 is depressed, the circuit is completed by completing the ground and the associated power signal is transmitted through the associated connection 180*b*, 180*c* and 180*d*.

As mentioned above, the control panel 42 also comprises indicator lights 59–63, which in the preferred embodiment are light emitting diodes (LED) where each of the LEDs is interconnected to a common 5-volt external source through the conductor 44e. The LEDs 63, 62, and 61 are interconnected to connections 122, 125, and 128, respectively, (FIG. 6) through the various connectors, 46, 52, 96, and 102, to provide for an ON-LINE light, a printing light, and a power light, respectively, each receiving the associated signal from the printing engine 26. The control panel 42 further comprises LEDs 60 and 59, having a common 5-volt source through conductor 44*k*, which is interconnected to electrical trace 137 (FIG. 6) and connected to an external 5-volt source at 138, as shown in FIG. 6. The LEDs 60 and 59 are indicator lights for the operator to add ink or paper to the printer, respectively, and receive signals through the connections 132 and 135, respectively, as shown in FIG. 6.

Thus, as identified above, the printing station 12 can be used in two alternative orientations, either of which is designated by the user. The printing station can be used in the conventional manner, as shown in FIG. 1, where the control panel faces outward and where the paper collection tray is on the opposite side of the control panel. Alternatively, the printing station can be used in a configuration shown in FIG. 2, where the printing station is oriented with the control panel and the paper collection tray on the same side facing outward towards the user. Advantageously, the printer includes two ports 50, 54, where each of the ports include electrical connectors 52, 57, respectively. The connectors 52, 57 have commoned connections from the printer timing control board 100 through the use of the ribbon cable sections 90, 94 common to the cable section 92.

Thus, to change the orientation of the printing station, the user simply removes the control panel 42 from port 50. The connectors 46 and 52 are also disconnected, and after removing the blank panel 56 from port 54, the connector 46 of the control panel 42 is reconnected to the connector 57 in port 54. The blank panel 56 is now placed over the newly exposed port 50. By including the identical connectors 52, 57 commonly interconnected as described above, with reference to FIG. 6 through 8, the control panel 42 can operate the printer identically from two different user selected locations.

Also, advantageously, the timing board includes voltage suppression means by way of metal oxide varistors 150 to prevent the electronic devices on the timing board 100. As the user control panel 42 is manually disconnected and reconnected to the connectors 52 or 57, the varistors prevent the electrostatic voltage buildup in the user's body from entering the timing board. Rather, the electrostatic voltage, which can approach levels of thousands of volts, is shunted to ground through the varistors 150.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A printing station for use in alternate orientations, comprising:

an outer printer housing having a first side and an opposite second side, said housing having a first opening means adjacent to said first side and a second opening means adjacent to said second side;

a printing head means intermediate said first and second sides;

paper feed means for feeding continuous paper from said second side to said printing head, and delivering said printed continuous paper in a return direction towards said second side;

paper collection means positioned adjacent to said second side for collecting the printed continuous paper from said printing head; and modular printer control means adapted for functional location in either said first or second opening means, thereby allowing said printing station to be rotated for alternate access to either said first or said second side.

2. The printing station of claim 1, wherein said modular printer control means comprises a control panel movable between said first and second openings.

3. The printing station of claim 2, wherein said modular printer control means further comprises cable means disposed adjacent to said first and second openings for interconnection with said control panel.

4. The printing station of claim 3, wherein said cable means include connection means interconnected to said cable means and disposed adjacent to said first and second openings.

5. The printing station of claim 4, wherein said control panel further comprises cable means interconnected thereto with connection means at a free end thereof, said control panel connection means being adapted for matable connection with alternative connection means adjacent to said first or second opening means.

6. The printing station of claim 1, wherein a lower surface of said printer include data and power input connections.

7. A printing station for use in alternate locations, comprising:

an outer printer housing having a first side and an opposite second side, said housing having a first port adjacent to said first side and a second port adjacent to said second side;

control cable means positioned adjacent to said first and second ports, said control cable means comprising multi-conductor cable having first and second electrical connector means terminated thereto, where said first electrical connector means is positioned proximate to said first port, said second electrical connector means is positioned proximate to said second port, said control cable means being adapted to position common control signals at said first and second ports; and printer control module means comprising a control panel having a multi-conductor cable interconnected thereto and a second electrical connector terminated to an opposite end of said cable, said second connector being matable with either of said first connectors and said control panel being mountable in either of said first or second ports for controlling said printer from alternative port locations.

8. The printing station of claim 7 further comprising a paper collection tray mounted adjacent to said second side, positioned to accumulate printed paper discharged by said printer.

9. The printing station of claim 7 further comprising control module means, positioned within said printer, interconnected to said control means.

10. The printing station of claim 9 wherein said control module means comprises a printed circuit board having electronic control devices disposed thereon.

11. The printing station of claim 10 wherein said control module means further comprises voltage suppression means disposed between at least some of said devices, and said cable means.

12. A reversible printing station assembly, comprising:

a printer having an outer housing having an upper surface, side surfaces, and front and rear surfaces, said printer further comprising printing head means positioned intermediate to said front and rear surfaces and paper feed means for delivering paper to said printing head means;

paper collection means positioned proximate to said rear surface for collecting paper printed by said printing head means;

printer support means adapted for rotation from a first position where said front surface is facing outward to a second position where said rear surface is facing outward; and printer control means operatively relocatable between positions adjacent to either said front or rear surface for controlling said printer from alternative locations.

13. The assembly of claim 12 wherein said printer control means comprises a control panel which is movable from a position adjacent to a first port to a position adjacent to a second port.

14. The assembly of claim 13 wherein each port has an electrical connector therein, profiled for alternative electrical connection with an electrical connector positioned on said control panel.

15. The assembly of claim 14 wherein the electrical connectors in the first and second ports are commoned by interconnecting cable means.

16. The assembly of claim 13 wherein the control panel is adapted for snap latching over either the first or second port, and further comprises a blank cover plate profiled for snap latching to the one port not carrying said control panel.

17. A printing station for use in alternate orientations, comprising:

a printer housing having a first side and an opposite second side, said housing having a first opening means adjacent to said first side and a second opening means adjacent to said second side;

a printing head means intermediate said first and second sides;

paper feed means for feeding continuous paper from said second side to said printing head, and delivering said printed continuous paper in a return direction towards said second side;

control means positioned in said printer housing for controlling said printer functions;

interconnection means comprising cable means electrically connected to said control means and connection means interconnected to said cable means and disposed adjacent to said first and second opening means;

a modular printer control panel adapted for positioning proximate to either said first or second opening means and profiled for electrical connection with said connection means, thereby allowing said printer to be rotated for alternate access to either said first or said second side.

18. The printing station of claim 17, wherein said control means comprises a printed circuit board mounted within said printer housing, said printed circuit board being interconnected to said printing head means and said paper feed means, and said modular printer control panel comprises actuation means for controlling said printing head means and said paper feed means.

19. The printing station of claim 18, wherein said control means includes voltage suppression means intermediate said interconnection to said printing head means and said paper feed means, and said actuation means.

20. The printing station of claim 19 wherein said voltage suppression means are varistors mounted on the printed circuit board.

21. A reversible printing station comprising:

a print stand, a printer housing mounted on said print stand, a printer mounted inside said housing, a first recess in said printer housing at a position affording easy user access from a first side of said print stand, a second recess in said printer housing at a position affording easy user access from a second side of said print stand opposite said first side, control means for controlling the operation of said printer, said control means being mounted within said housing, first and second connector means mounted in said first and second recesses respectively, cable means connecting said control means to said first and second connectors, and a removable control panel configured for insertion into either of said first or second recesses and provided with third connector means for connection to either of said first or second connector means.

22. A reversible printing station according to claim 21 wherein said printer housing has a generally horizontal top surface; said recesses being symmetrically positioned on said surface near alternate corners thereof.

23. A reversible printing station according to claim 22, said printer housing having an elevated lower surface and said printing station further comprising electrical connection means connected to said lower surface for communication between said control means and a remote location.

24. A reversible printing station according to claim 21 further comprising discharge means connected to said cable means for discharging static electricity collected at said first and second connector means.

* * * * *